US010834998B2

(12) United States Patent
Workman et al.

(10) Patent No.: US 10,834,998 B2
(45) Date of Patent: Nov. 17, 2020

(54) FOOTWEAR INCLUDING A HOLDING CAGE

(71) Applicant: Wolverine Outdoors, Inc., Rockford, MI (US)

(72) Inventors: Steven A. Workman, Grand Rapids, MI (US); William J. Cass, Belmont, MI (US); Clark A. Matis, Durango, CO (US)

(73) Assignee: Wolverine Outdoors, Inc., Rockford, MI (US)

( * ) Notice: Subject to any disclaimer, the term of this patent is extended or adjusted under 35 U.S.C. 154(b) by 172 days.

(21) Appl. No.: 15/981,234

(22) Filed: May 16, 2018

(65) Prior Publication Data

US 2019/0313740 A1 Oct. 17, 2019

Related U.S. Application Data

(63) Continuation-in-part of application No. 29/643,957, filed on Apr. 13, 2018, now Pat. No. Des. 877,477.

(51) Int. Cl.

| | |
|---|---|
| ***A43B 23/22*** | (2006.01) |
| ***A43B 7/20*** | (2006.01) |
| *A43B 5/00* | (2006.01) |

(52) U.S. Cl.

CPC ..... *A43B 23/227* (2013.01); *A43B 7/20* (2013.01); *A43B 5/002* (2013.01)

(58) Field of Classification Search

CPC ..... A43B 23/227; A43B 23/088; A43B 23/16; A43B 13/222; A43B 23/22;

(Continued)

(56) References Cited

U.S. PATENT DOCUMENTS 1,683,465 A * 9/1928 Hill ..... A43C 11/004 36/50.1
2,147,197 A * 2/1939 Glidden ..... A43B 1/02 36/9 R (Continued)

OTHER PUBLICATIONS

Generic Korean Footwear, downloaded from http://www.buykorea.org/product-details/CLIMING-SHOES-WALKING-SAFETY-LEATHER-MESH--3042382.html on Feb. 6, 2018.

(Continued)

*Primary Examiner* — Heather Mangine

(74) *Attorney, Agent, or Firm* — Warner Norcross + Judd LLP

(57) ABSTRACT

An article of footwear includes an upper having a lacing system, an underfoot support plate, and a holding cage that has support members extending up from the support plate, forming a portion of a cradle around and rearward of a wearer's calcaneus bone. The support members join with the lacing system so when the cage is in a loaded state, the system translates a forward force of a wearer's instep against it, through the members so the cradle is pulled toward the calcaneus bone, with the lacing system, to impair the foot from sliding forward over the support plate. The footwear can include a tensioning member, joined with the system and a constrictor strap that wraps rearward around an ankle of the wearer, and operable in a tightening mode in which the lace is tightened to lock the holding cage against the heel and tighten the strap around the ankle.

12 Claims, 10 Drawing Sheets

(58) Field of Classification Search
CPC ..... A43B 23/0235; A43B 23/0265; A43B 23/0275; A43B 7/18; A43B 7/20; A43B 5/002; A43B 13/41; A43B 13/42; A43C 11/16; A43C 11/165
USPC ..... 36/149, 45, 72 A, 68, 69, 76 R
See application file for complete search history.

(56) References Cited

U.S. PATENT DOCUMENTS 4,130,947 A 12/1978 Denu
4,366,632 A 1/1983 Bente
4,972,613 A * 11/1990 Loveder ..... A43B 5/00 36/105
5,243,772 A * 9/1993 Francis ..... A43B 5/00 36/106
5,319,868 A * 6/1994 Hallenbeck ..... A43C 11/00 36/50.1
5,319,869 A * 6/1994 McDonald ..... A43B 5/00 36/114
5,377,430 A * 1/1995 Hatfield ..... A43B 3/08 24/714.6
5,381,609 A * 1/1995 Hieblinger ..... A43C 11/00 36/50.1
5,533,279 A * 7/1996 Mitsui ..... A43B 5/00 36/45
D374,117 S 10/1996 Fumy et al.
D376,471 S 12/1996 Kalin et al.
5,657,557 A * 8/1997 Hull ..... A43C 7/00 36/50.1
5,692,319 A * 12/1997 Parker ..... A43B 7/1495 36/114
5,771,608 A * 6/1998 Peterson ..... A43B 5/00 36/50.1
5,791,021 A * 8/1998 James ..... A43C 1/003 24/68 SK
6,000,148 A * 12/1999 Cretinon ..... A43B 5/00 36/69
6,029,376 A * 2/2000 Cass ..... A43C 1/04 36/50.1
6,052,921 A * 4/2000 Oreck ..... A43C 1/00 36/50.1
6,151,804 A * 11/2000 Hieblinger ..... A43B 5/02 36/128
6,199,303 B1 3/2001 Luthi et al.
6,289,558 B1 * 9/2001 Hammerslag ..... A43B 5/16 24/68 SK
6,301,806 B1 10/2001 Heller
6,416,610 B1 * 7/2002 Matis ..... A43B 13/10 156/245
6,421,937 B2 7/2002 Heller
6,477,791 B2 11/2002 Luthi et al.
6,499,235 B2 12/2002 Lussier et al.
6,528,140 B1 3/2003 Kalin et al.
6,715,218 B2 4/2004 Johnson
6,722,058 B2 4/2004 Lucas et al.
6,748,677 B2 6/2004 Briant et al.
6,782,642 B2 8/2004 Knoche et al.
6,807,753 B2 10/2004 Steszyn et al.
6,817,112 B2 11/2004 Berger et al.
6,920,705 B2 7/2005 Lucas et al.
6,931,765 B2 8/2005 Lucas et al.
6,954,998 B1 * 10/2005 Lussier ..... A43B 5/02 36/107
6,957,503 B2 10/2005 De Paoli
6,962,008 B2 11/2005 Manz et al.
6,983,553 B2 1/2006 Lussier et al.
6,983,557 B2 1/2006 Manz et al.
7,013,582 B2 3/2006 Lucas et al.
7,140,124 B2 11/2006 Manz et al.
7,181,869 B2 2/2007 Seydel et al.
7,188,439 B2 3/2007 DiBenedetto et al.
7,225,565 B2 6/2007 DiBenedetto et al.
7,350,320 B2 4/2008 Chandler et al.
7,401,419 B2 7/2008 Lucas et al.
7,401,422 B1 * 7/2008 Scholz ..... A43B 5/049 36/102
7,406,781 B2 8/2008 Scholz
7,441,349 B2 10/2008 Seydel et al.
7,481,009 B2 1/2009 De Paoli
7,487,602 B2 2/2009 Berger et al.
7,506,460 B2 3/2009 DiBenedetto et al.
7,596,891 B2 10/2009 Carnes et al.
7,631,382 B2 12/2009 DiBenedetto et al.
7,637,032 B2 12/2009 Sokolowski et al.
7,644,518 B2 1/2010 Chandler et al.
7,647,709 B2 * 1/2010 Reilly ..... A43B 7/142 36/107
7,665,232 B2 2/2010 Manz et al.
7,676,960 B2 3/2010 DiBenedetto et al.
7,676,961 B2 3/2010 DiBenedetto et al.
7,716,852 B2 5/2010 Berger et al.
7,721,348 B2 5/2010 Nurnberg
7,730,637 B2 6/2010 Scholz
7,827,706 B2 11/2010 Briant et al.
7,918,811 B2 4/2011 Lussier et al.
7,980,009 B2 7/2011 Carnes et al.
8,001,704 B2 * 8/2011 Baudouin ..... A43B 7/1495 36/102
8,006,411 B2 8/2011 Manz et al.
8,056,268 B2 11/2011 DiBenedetto et al.
8,122,615 B2 2/2012 Lucas et al.
8,186,081 B2 5/2012 Wilson, III et al.
8,209,882 B2 7/2012 Leimer et al.
8,234,798 B2 8/2012 DiBenedetto et al.
8,327,559 B2 12/2012 Berger et al.
8,458,929 B2 6/2013 Carnes et al.
8,522,457 B2 9/2013 Scholz et al.
8,567,096 B2 10/2013 Scholz
8,584,378 B2 11/2013 Weidl et al.
8,590,345 B2 11/2013 Sokolowski et al.
8,696,520 B2 4/2014 Ellis et al.
9,032,647 B2 5/2015 Carnes et al.
9,087,159 B2 7/2015 Oleson et al.
9,179,739 B2 * 11/2015 Bell ..... A43C 11/002
9,591,890 B2 * 3/2017 Too-a-Foo ..... A43C 19/00
9,717,305 B2 * 8/2017 Midorikawa ..... A43C 11/165
2002/0007570 A1 * 1/2002 Girard ..... A43C 1/00 36/88
2002/0124436 A1 * 9/2002 Hatfield ..... A43B 3/163 36/45
2002/0139008 A1 * 10/2002 Delgorgue ..... A43B 5/0411 36/50.1
2002/0174571 A1 11/2002 Briant et al.
2003/0208928 A1 11/2003 Steszyn et al.
2003/0208929 A1 11/2003 Lucas et al.
2004/0098883 A1 * 5/2004 Clafton ..... A43B 7/20 36/58.5
2004/0107606 A1 6/2004 De Paoli
2004/0148799 A1 8/2004 Lussier et al.
2004/0168352 A1 9/2004 Lucas et al.
2004/0177531 A1 9/2004 DiBenedetto et al.
2004/0205982 A1 * 10/2004 Challe ..... A43B 9/02 36/55
2004/0221482 A1 * 11/2004 Berger ..... A43B 7/08 36/3 B
2004/0221488 A1 11/2004 Seydel et al.
2005/0013513 A1 1/2005 Manz et al.
2005/0065270 A1 3/2005 Knoerr et al.
2005/0126042 A1 * 6/2005 Baier ..... A43B 7/18 36/50.1
2005/0166423 A1 8/2005 Norton
2005/0198868 A1 9/2005 Scholz
2005/0267775 A1 * 12/2005 Willis ..... A43B 3/24 705/1.1
2005/0274045 A1 * 12/2005 Selner ..... A41B 11/003 36/89
2006/0080864 A1 * 4/2006 Chen ..... A43B 7/20 36/89
2006/0205303 A1 9/2006 Nurnberg
2006/0265905 A1 11/2006 Chandler et al.
2006/0283050 A1 12/2006 Carnes et al.

(56) References Cited

U.S. PATENT DOCUMENTS

2006/0288612 A1 12/2006 Lucas et al.
2007/0011912 A1* 1/2007 Clark ..... A43B 1/14 36/50.1
2007/0011914 A1* 1/2007 Keen ..... A43B 1/14 36/50.1
2007/0011920 A1 1/2007 DiBenedetto et al.
2007/0022633 A1 2/2007 Seydel et al.
2007/0068041 A1* 3/2007 Farys ..... A43B 5/0439 36/50.1
2007/0180736 A1 8/2007 DiBenedetto et al.
2007/0180737 A1 8/2007 DiBenedetto et al.
2007/0256329 A1* 11/2007 Antonelli ..... A43B 1/0009 36/68
2008/0155859 A1 7/2008 Chandler et al.
2008/0263904 A1 10/2008 Scholz
2008/0271342 A1 11/2008 Lucas et al.
2008/0289222 A1* 11/2008 Candrian ..... A43B 1/0027 36/101
2009/0113762 A1 5/2009 Leimer et al.
2009/0199435 A1* 8/2009 Robinson, Jr. ..... A43C 1/06 36/108
2009/0265958 A1 10/2009 DiBenedetto et al.
2009/0300947 A1* 12/2009 Babolat ..... A43B 7/20 36/114
2009/0313857 A1 12/2009 Carnes et al.
2010/0018075 A1* 1/2010 Meschter ..... A43B 23/227 36/45
2010/0036306 A1* 2/2010 Lussier ..... A43B 3/0005 602/65
2010/0050478 A1 3/2010 DiBenedetto et al.
2010/0083535 A1* 4/2010 Meschter ..... A43B 7/1495 36/88
2010/0107442 A1* 5/2010 Hope ..... A43B 1/04 36/50.1
2010/0154258 A1 6/2010 Scholz et al.
2010/0292599 A1 11/2010 Oleson et al.
2011/0010964 A1* 1/2011 Hardy ..... A43B 13/36 36/103
2011/0030245 A1* 2/2011 Truelsen ..... A43B 5/06 36/30 R
2011/0113650 A1* 5/2011 Hurd ..... A43B 23/08 36/107
2011/0138652 A1 6/2011 Lucas et al.
2011/0197475 A1* 8/2011 Weidl ..... A43B 1/0009 36/107
2011/0203142 A1 8/2011 Scholz
2011/0239488 A1 10/2011 Carnes et al.
2011/0308115 A1* 12/2011 Le ..... A43B 7/1495 36/9 R
2012/0030965 A1* 2/2012 Greene ..... A43B 9/00 36/10
2012/0174433 A1* 7/2012 Mahoney ..... A43B 7/1425 36/28
2012/0198721 A1* 8/2012 Cavaliere ..... A43B 7/14 36/42
2012/0198727 A1* 8/2012 Long ..... A43B 23/0235 36/25 R
2012/0198730 A1* 8/2012 Burch ..... B29D 35/02 36/30 R
2013/0019500 A1* 1/2013 Greene ..... A43B 23/025 36/50.1
2013/0031801 A1* 2/2013 Hatfield ..... A43B 13/188 36/83
2013/0104422 A1* 5/2013 Hatfield ..... A43B 5/001 36/103
2013/0173033 A1 7/2013 Oleson et al.
2013/0211563 A1 8/2013 Ellis et al.
2013/0247423 A1 9/2013 Carnes et al.
2013/0263349 A1* 10/2013 Roser ..... A43B 5/002 2/22
2013/0312293 A1* 11/2013 Gerber ..... A43B 23/17 36/34 R
2014/0005585 A1* 1/2014 Berns ..... A61F 5/0127 602/27
2014/0059896 A1 3/2014 Weidl et al.
2014/0100677 A1 4/2014 Ellis et al.
2014/0130372 A1* 5/2014 Aveni ..... D04B 1/22 36/83
2014/0173938 A1* 6/2014 Beye ..... A43B 9/12 36/102
2014/0196316 A1* 7/2014 Follet ..... A43B 23/0245 36/84
2014/0223771 A1* 8/2014 Berend ..... A43B 23/0275 36/83
2014/0223775 A1* 8/2014 Fleuren ..... A61F 5/0111 36/89
2014/0237858 A1* 8/2014 Adami ..... A43B 23/0205 36/107
2014/0243724 A1* 8/2014 Dodin ..... A43B 7/20 602/27
2014/0259760 A1* 9/2014 Dojan ..... A43B 23/0275 36/45
2014/0305005 A1* 10/2014 Yeh ..... A43B 7/143 36/69
2015/0013187 A1* 1/2015 Taniguchi ..... A43B 1/04 36/84
2015/0121724 A1* 5/2015 Sung ..... A43B 23/0235 36/87
2015/0143720 A1* 5/2015 Avar ..... A43B 23/16 36/107
2015/0210034 A1* 7/2015 Tarrier ..... A43B 23/0235 428/113
2015/0216258 A1* 8/2015 Ueda ..... A43B 1/14 36/87
2015/0257476 A1* 9/2015 Panian ..... A43B 5/00 36/114
2015/0289584 A1* 10/2015 Nurse ..... A43B 3/0031 36/89
2015/0313316 A1* 11/2015 Boucher ..... A43B 23/042 36/93
2015/0342261 A1* 12/2015 Boucher ..... A43B 1/04 36/84
2016/0088901 A1* 3/2016 Mahoney ..... A43B 23/22 36/108
2016/0128424 A1* 5/2016 Connell ..... A43B 23/0265 36/103
2016/0174661 A1* 6/2016 Nonogawa ..... A43B 23/0235 36/88
2016/0206044 A1* 7/2016 Dimoff ..... A43B 1/04
2016/0213096 A1* 7/2016 Borel ..... A43B 7/085
2016/0270484 A1* 9/2016 Zadnik ..... A43B 23/0205
2016/0324269 A1* 11/2016 Dombrow ..... A43C 1/04
2016/0338449 A1* 11/2016 Steuerwald ..... A43B 5/14
2016/0366980 A1* 12/2016 Bell ..... A43C 1/04
2017/0006965 A1* 1/2017 Musho ..... A43B 7/06
2017/0042290 A1* 2/2017 Hatfield ..... A43B 3/242
2017/0079827 A1* 3/2017 Ostergard ..... A61F 5/0111
2017/0105489 A1* 4/2017 Lovett ..... A43C 1/00
2017/0143075 A1* 5/2017 Nonogawa ..... A43B 23/0235
2017/0181501 A1* 6/2017 Gautier ..... A43B 13/122
2017/0202310 A1* 7/2017 Spanks ..... A43B 3/101
2017/0202311 A1* 7/2017 Klug ..... A43B 19/00
2017/0208900 A1* 7/2017 Boucher ..... A43B 23/042
2017/0215523 A1* 8/2017 Nishiwaki ..... A43B 23/02
2017/0231319 A1* 8/2017 Bohnsack ..... A43B 7/28 36/92
2017/0273814 A1* 9/2017 Berns ..... A43C 1/003
2018/0064213 A1* 3/2018 Dojan ..... A43B 23/0275
2018/0110295 A1* 4/2018 Dyer ..... A43C 7/06
2018/0116337 A1* 5/2018 Montross ..... A43B 13/04
2018/0116340 A1* 5/2018 Chang ..... A43B 23/17
2018/0199659 A1* 7/2018 Lintaman ..... A43C 11/146
2018/0249787 A1* 9/2018 Fuerst, Sr. ..... A43C 7/00
2018/0338566 A1* 11/2018 Hatfield ..... A43B 23/0245
2018/0343974 A1* 12/2018 Hancock ..... A43B 9/00
2019/0029368 A1* 1/2019 Crumbleholme ..... B32B 37/185
2019/0037970 A1* 2/2019 Klug ..... A43C 1/00

(56) References Cited

U.S. PATENT DOCUMENTS

| | | | | |
|---|---|---|---|---|
| 2019/0104808 | A1* | 4/2019 | Kovach | A43C 11/165 |
| 2019/0174872 | A1* | 6/2019 | Kawano | A43C 11/165 |
| 2019/0231030 | A1* | 8/2019 | Uesato | A43B 23/0265 |

OTHER PUBLICATIONS

Nike Air Presto 'Harbour Blue' returns, Kickspotting, https://web.archive.org/web/20151022131423/http://www.kickspotting.com/features/nike-air-presto-harbour-blue-returns/, pp. 1-10, Oct. 22, 2015.

Li-Ning Mix, Brian Betschart, https://www.sneakerfiles.com/li-ning-mix/, pp. 1-2, Mar. 15, 2011.

Adidas adipower boost BOA Golf Shoes, Discount Golf World, https://web.archive.org/web/20150405021251/https://www.discountgolfworld.com/adidas-adipower-boost-boa-golf-shoes-p31148, pp. 1-2, Apr. 5, 2015.

Adidas Golf: TOUR360 BOA BOOST—Eighteen Under Par, www.eighteenunderpar.com/blog/2016/02/05/adidas-tour360-boa-boost/, pp. 1-4, Feb. 5, 2016.

* cited by examiner

FOOTWEAR INCLUDING A HOLDING CAGE

BACKGROUND OF THE INVENTION

The present invention relates to footwear, and more particularly to a footwear construction having a holding cage that envelops and locks a wearer's foot within the footwear.

There is a variety of performance and hiking shoes available in the market. Many of these shoes include uppers and soles that are constructed from multiple components that are stitched, glued or otherwise fastened to one another along the length of the footwear, from heel to toe. Most of these shoes are constructed with the objective of forming a tight but comfortable envelope around the wearer's foot, to provide a stable and durable enclosure for the foot. Where the shoes include the multiple components fastened one another, over time, or under significant stress, the components can move and stretch relative to one another. As a result, the foot within the enclosure of the upper can move forward in small or sometimes large amounts. In some cases, where the movement is significant, the toes of the foot can forcibly push into a toe box of the upper, thereby causing discomfort particularly when the shoes are used to traverse a downhill contour.

In an attempt to better secure the wearer's foot relative to the sole, some manufacturers produce shoes to include leather or plastic parts that extend upwardly from an arch of the sole to a lacing of the footwear. The lacing envelop and secure the wearer's foot so that the parts are pulled inward against the lateral and medial sides of the wearer's foot in the arch region, with a lacing over the instep. Over time, the parts can begin to pull away from the sole so that even when the lacing is tightened, it does not thoroughly secure the foot to the sole. Further, due to excessive forces generated by the wearer's foot pushing forward on the lacing and pulling the parts, those parts can stretch and/or move, thereby allowing the foot to slide forward over the sole, again resulting in wearer's toes being forced into the toe box and potentially causing discomfort to the wearer.

Accordingly, there remains room for improvement in the area producing footwear that dynamically secures a wearer's foot within that footwear, and prevents the foot from sliding forward to pinch a wearer's toes within the toe box of the footwear.

SUMMARY OF THE INVENTION

A footwear construction is provided including an upper having a lacing system, an underfoot support plate, and a holding cage that has support members extending up from the support plate, forming a portion of a cradle around and rearward of a wearer's calcaneus bone. The support members can join with the lacing system so when the holding cage is in a loaded state, the lacing system translates a forward force of a wearer's instep against the holding cage, through the support members so the cradle is pulled toward the calcaneus bone, with the lacing system, to thereby impair the foot from sliding forward over the support plate.

In one embodiment, the holding cage and support plate can be constructed from a common material and can be integrally formed with one another. The support plate can be rigid but flexible and can extend optionally continuously across a full width of the footwear and along a substantial length of the footwear. In some cases, the support plate can extend from toe to heel, and can be disposed above the outsole, between it and the upper.

In another embodiment, the support members can include first and second support members on a lateral side of the footwear, and third and fourth support members on a medial side of the footwear. The first and third members can extend outward from the support plate in a location forward and/or adjacent the calcaneus bone of the wearer. The first and third support members can be free-floating relative to and/or disposed over a lateral exterior surface of the upper. The second and fourth support members can extend from a location located to the rear of the calcaneus bone, forward toward the respective first and third support members.

In still another embodiment, the second and fourth support members can include ends to join with ends of the first and third support members. These ends can be joined with the lacing system.

In yet another embodiment, the second support member and the fourth support member can integrally form a cradle that extends around and rearward of the calcaneus bone of the wearer. Optionally, the cradle can also be integrally formed with the support plate, and can extend upwardly from a rear portion of the support plate.

In even another embodiment, the support plate can be void of any holes or apertures extending completely through the support plate, except in a few select locations, such as under the calcaneus bone and/or in the forefoot.

In a further embodiment, the footwear can be configured such that when a forward force of the wearer's instep is projected against the lacing system, the holding cage attains a loaded state. That forward force is distributed between the first support member and a second support member such that a tension in the second support member relative to a tension in the first support member is a ratio of optionally at least 1.25:1; further optionally at least 1.5:1, yet further optionally at least 2:1. The respective tensions in the third and fourth support members can be distributed in a similar ratio.

In still a further embodiment, the footwear can include a tensioning member, joined with the lacing system, which itself is joined with second, third and fourth support members on opposing lateral and medial sides of the upper. The tensioning member can be operable in a tightening mode in which the laces tighten to thereby pull the holding cage against lateral and medial exterior surfaces of the upper. The tightening also can pull the lacing system toward the cradle and support members, and vice versa, thereby locking the calcaneus bone in place within the cradle between the support members on opposite sides of the upper. The support members also pull the support plate upward to lock the instep and forefoot between the lacing system and the support plate to provide a secure envelop around the wearer's foot.

In yet a further embodiment, the footwear can include a constrictor strap that wraps rearward around an ankle of the wearer. The constrictor strap can be joined with a tensioning member on one side of the upper, and can be free-floating relative to a portion of the exterior surface of the upper. The tensioning member in the tightening mode can simultaneously tighten the constrictor strap around an ankle of the wearer, to further lock the upper to the wearer's ankle.

In even a further embodiment, the tensioning member can include a dial rotatably joined with a base. The base can be fixedly secured to the exterior of one side of the upper. The constrictor strap can include a first end, a distal second end and a central part therebetween. The first end can be secured to the base, the central part can be free-floating relative to and around the rear of the ankle of the wearer. The second end of the constrictor strap can be joined with a lacelet or part of the upper on the opposite side of the upper, where that lacelet is optionally also fixed and stationary relative to the upper.

The current embodiments provide footwear that can dynamically fit a variety of foot shapes and can aggressively and securely envelop and enclose a foot disposed inside the footwear. With the holding cage described herein, a user can utilize a lacing system to positively lock their foot between the lacing system and a cradle formed by support members and/or the support plate. This can prevent the wearer's foot from sliding forward over the support plate of the footwear and subsequently impair the forcing the toes of the wearer's foot into a toe box of the footwear. Where the constrictor strap is included, that too can positively lock the upper around the ankle of the wearer to provide further securement and stabilizing structure to the wearer's ankle.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
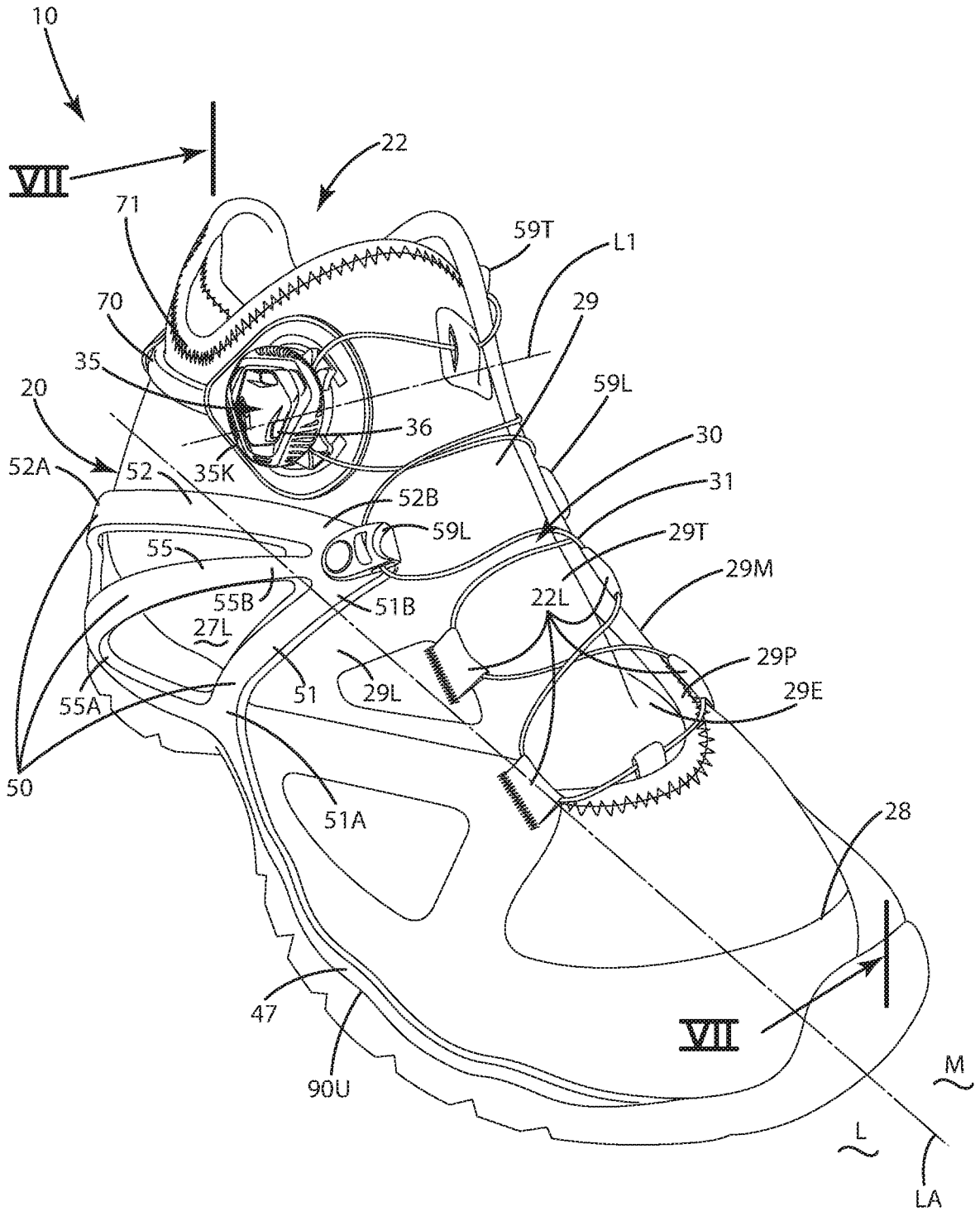
FIG. 1 is a front perspective view of a current embodiment of the footwear including a holding cage and a lacing system.

A current embodiment of the footwear is illustrated in FIGS. 1-9 and generally designated 10. The footwear 10 can include an upper 20 having a lacing system 30, an underfoot support plate 40 and one or more support members 50 extending upward from the support plate and joined with the lacing system 30. The support members 50 can cooperatively form a portion of a cradle 80 that extends around and rearward of a wearer's W calcaneus bone C. The support members 50, which can be located on the lateral and medial sides of the frame or holding cage 60, which can comprise the underfoot support plate and one or more of the support members, can cooperate with the lacing system 30 so that when the frame and/or holding cage is in a loaded state, the lacing system transfers a forward force F1 of the wearer's instep I through the support members 50 so that the cradle 80 is pulled toward the calcaneus bone C with the lacing system 30. In turn, this impairs the foot from sliding forward over the support plate. This can be helpful in a variety of conditions and on a variety of terrain for example, when a user is traversing a downhill slope in a downhill direction. In such a case, because the user's foot is locked in place relative to the support members and the frame, the user's foot will not slide forward over the support plate and press the toes of the wearer against the interior 28F of the toe box 28 of the upper 20.

Although the current embodiment of footwear is illustrated in the context of a hiking shoe or performance shoe, it may be incorporated into any type or style of footwear, including casual shoes, trail shoes and boots, work boots, all-terrain shoes, barefoot running shoes, athletic shoes, running shoes, sneakers, conventional tennis shoes, walking shoes, multisport footwear, boots, dress shoes or any other type of footwear or footwear components. It also should be noted that directional terms, such as "vertical," "horizontal," "top," "bottom," "upper," "lower," "inner," "inwardly," "outer", "outwardly," "below" and "above" are used to assist in describing the embodiments based on the orientation of the embodiments shown in the illustrations.

Further, the terms "medial," "lateral" and "longitudinal" are used in the manner commonly used in connection with footwear. For example, when used in referring to a side of the shoe, the term "medial" refers to the inward side (that is, the side facing the other shoe) and "lateral" refers to the outward side. When used in referring to a direction, the term "longitudinal direction" refers to a direction generally extending along the length of the shoe between toe and heel, and the term "lateral direction" refers to a direction generally extending across the width of the shoe between the medial and lateral sides of the shoe. The use of directional terms should not be interpreted to limit the invention to any specific orientation.

Additionally, as used herein, the term "arch region" (or arch or midfoot) refers generally to the portion of the footwear or sole assembly corresponding to the arch or midfoot of the wearer's foot; the term "forefoot region" (or forefoot) refers generally to the portion of the footwear forward of the arch region corresponding to the forefoot (for example, including the ball and the toes) of a wearer's foot; and the term "heel region" (or heel) refers generally to that portion of the footwear rearward of the arch region corresponding to the heel of the wearer's foot. The forefoot region 17, arch region or midfoot region 18 and heel region 19 generally are identified in FIG. 3. However, it is to be understood that delineation of these regions may vary depending upon the configuration of the sole assembly and/or footwear.

Figure 3:
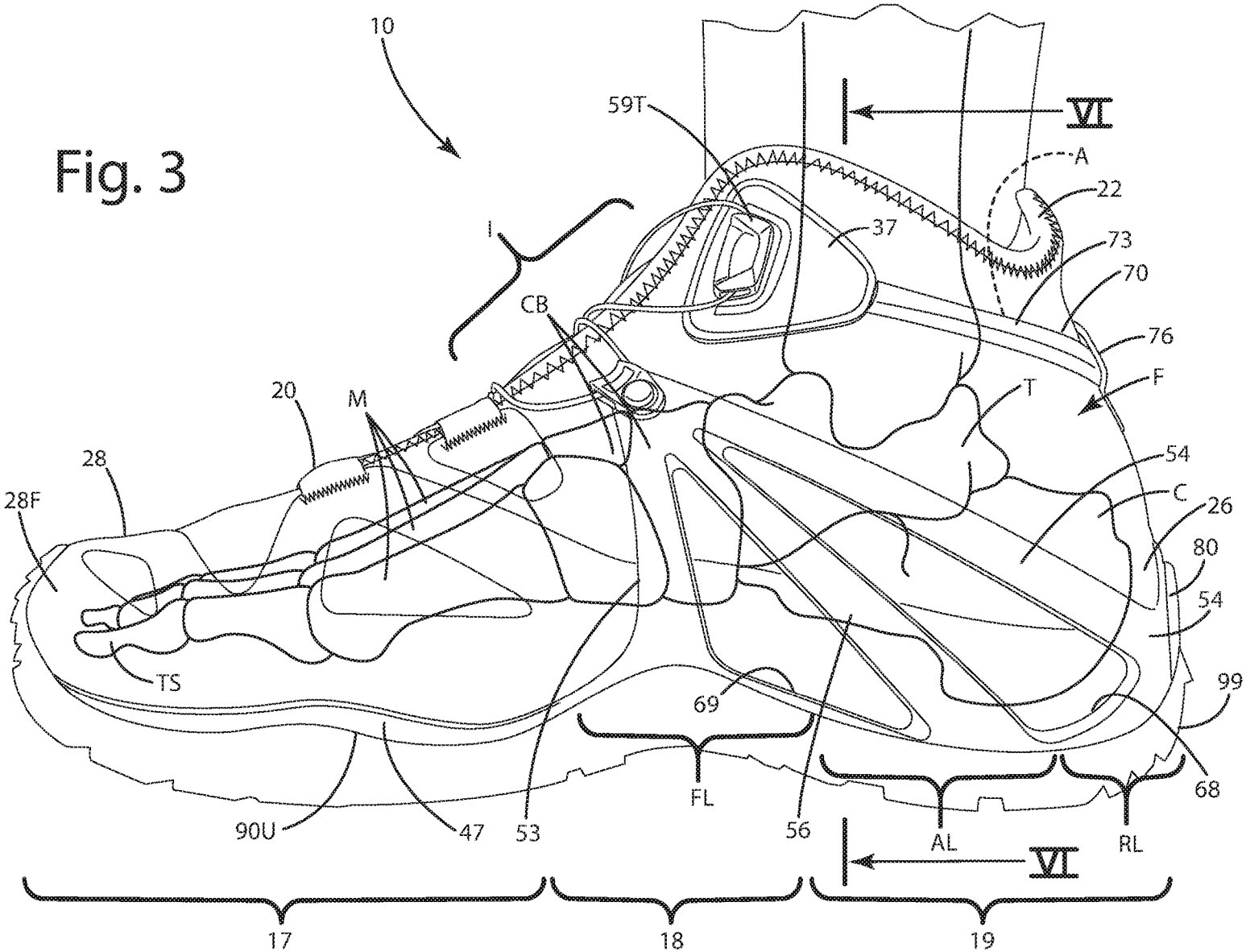
FIG. 3 is a medial side view of the footwear.

The current embodiments of the footwear 10 can include features that are positioned relative to certain bones in a foot F of the wearer W. Referring to FIG. 3, the general location of some of those bones is illustrated. For example, the metatarsals extend generally in the forefoot region 17, sometimes extending into the midfoot region 18, depending on the anatomy of the wearer. The cuneiform bones CB generally are disposed in the midfoot region 18 and form with the metatarsals a portion of the instep I across the top of the wearer's foot F. Rearward of the cuneiform bones CB is the talus T which extends above the calcaneum or calcaneus bone C. Sometimes, the calcaneus bone C is referred to herein as the heel bone or heel of the wearer's foot F. With further reference to FIG. 3, certain support members can be located at certain locations relative to the calcaneus bone C. For example, these locations can include first and third locations, FL, which can be disposed on either the lateral or medial side of the foot or footwear, and generally forward of the calcaneus bone C of the wearer W. These locations can include second and fourth locations RL, which can be disposed on either the lateral or medial side of the foot or footwear, and generally adjacent and/or at or around the rearmost portion of the calcaneus bone, optionally extending beyond the rearmost portion of the calcaneus bone. These locations can include fifth and sixth locations AL, which can be disposed on either the lateral or medial side of the foot or footwear, and generally adjacent the lateral and medial sides of the calcaneus bone, and optionally between the first or third locations FL in the second and fourth locations RL.

Figure 6:
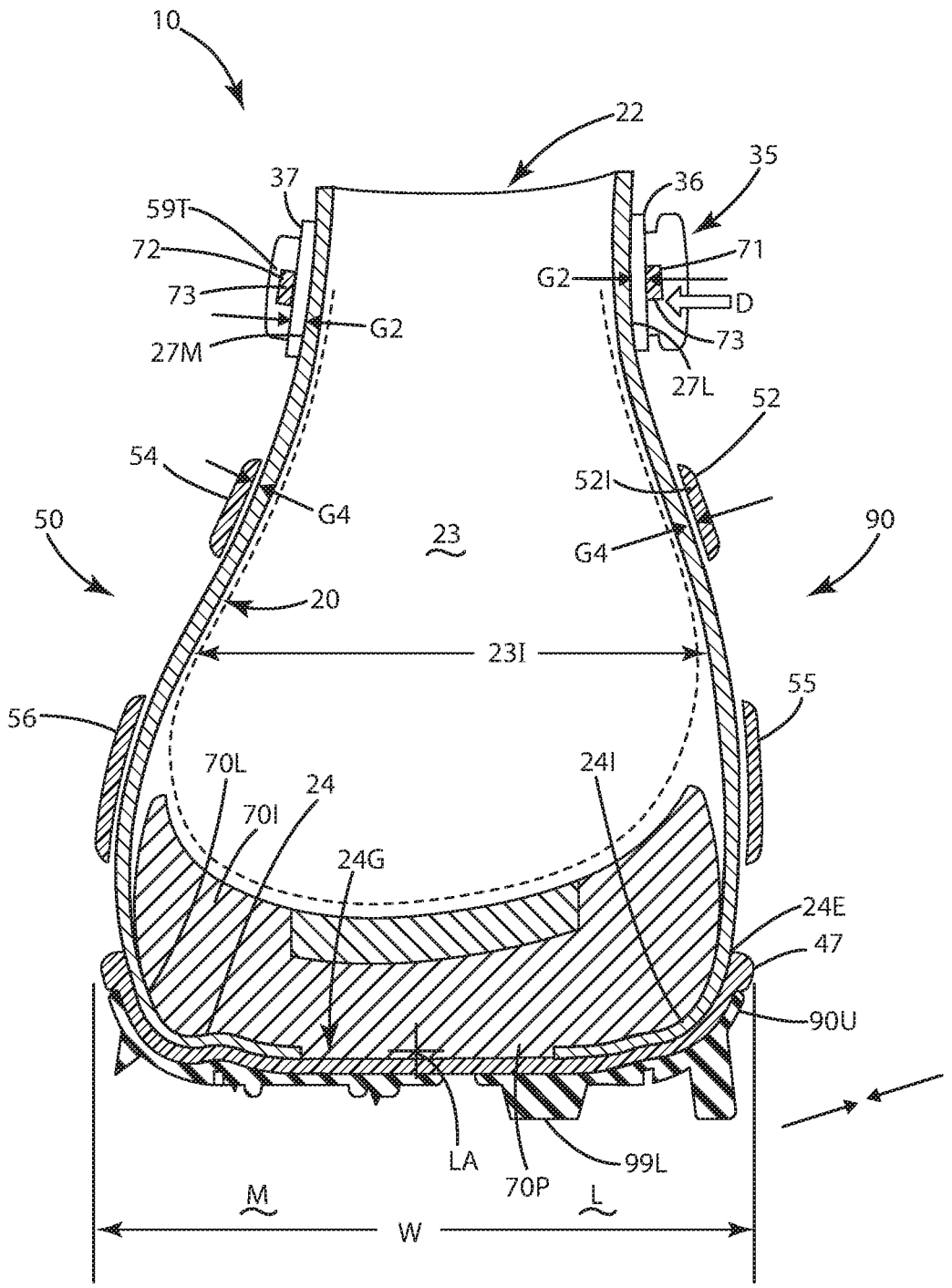
FIG. 6 is a section view taken along lines VI-VI of FIG. 3.
Figure 7:
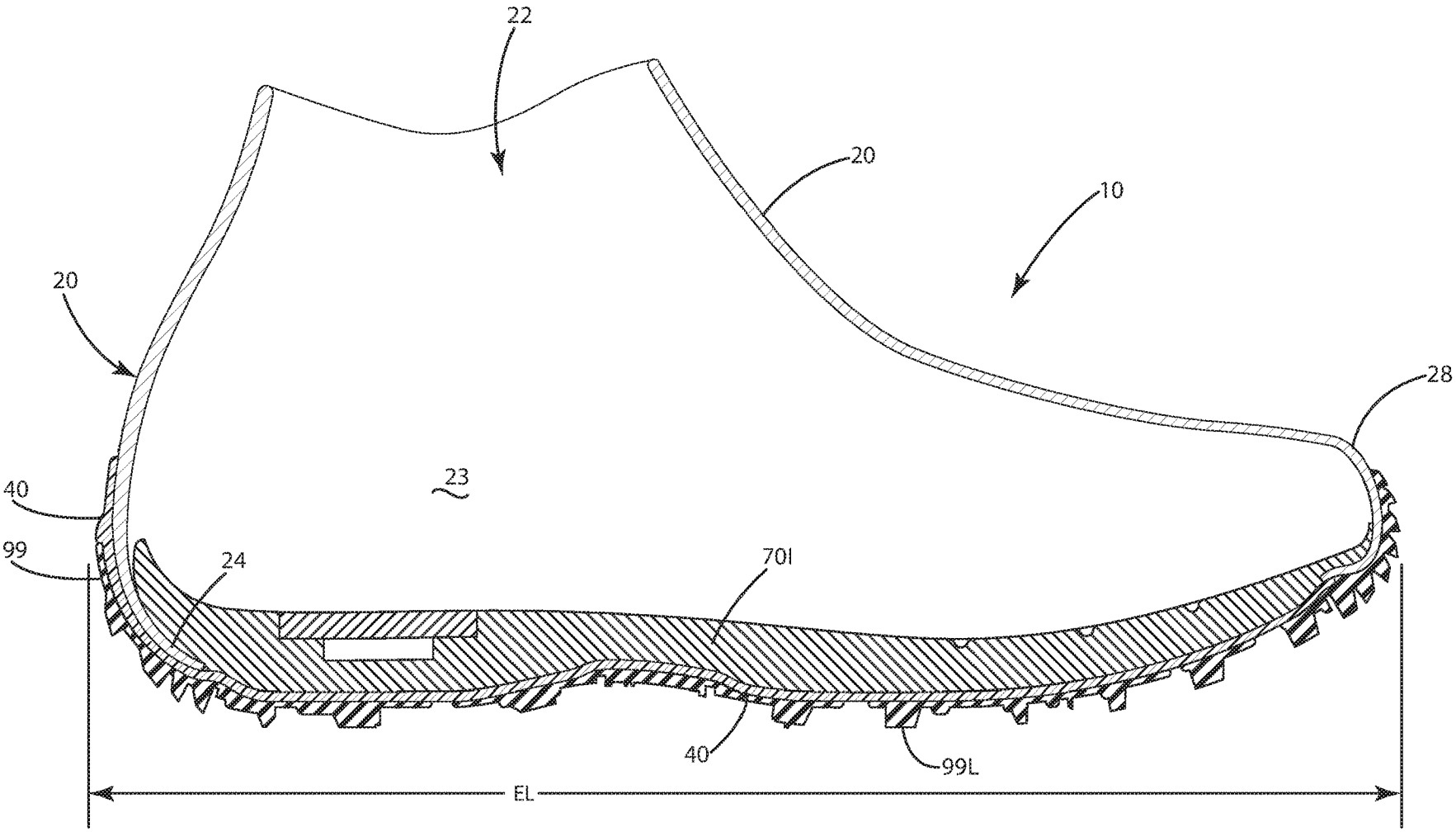
FIG. 7 is a section view taken along lines VII-VII of FIG. 3.
Figure 8:
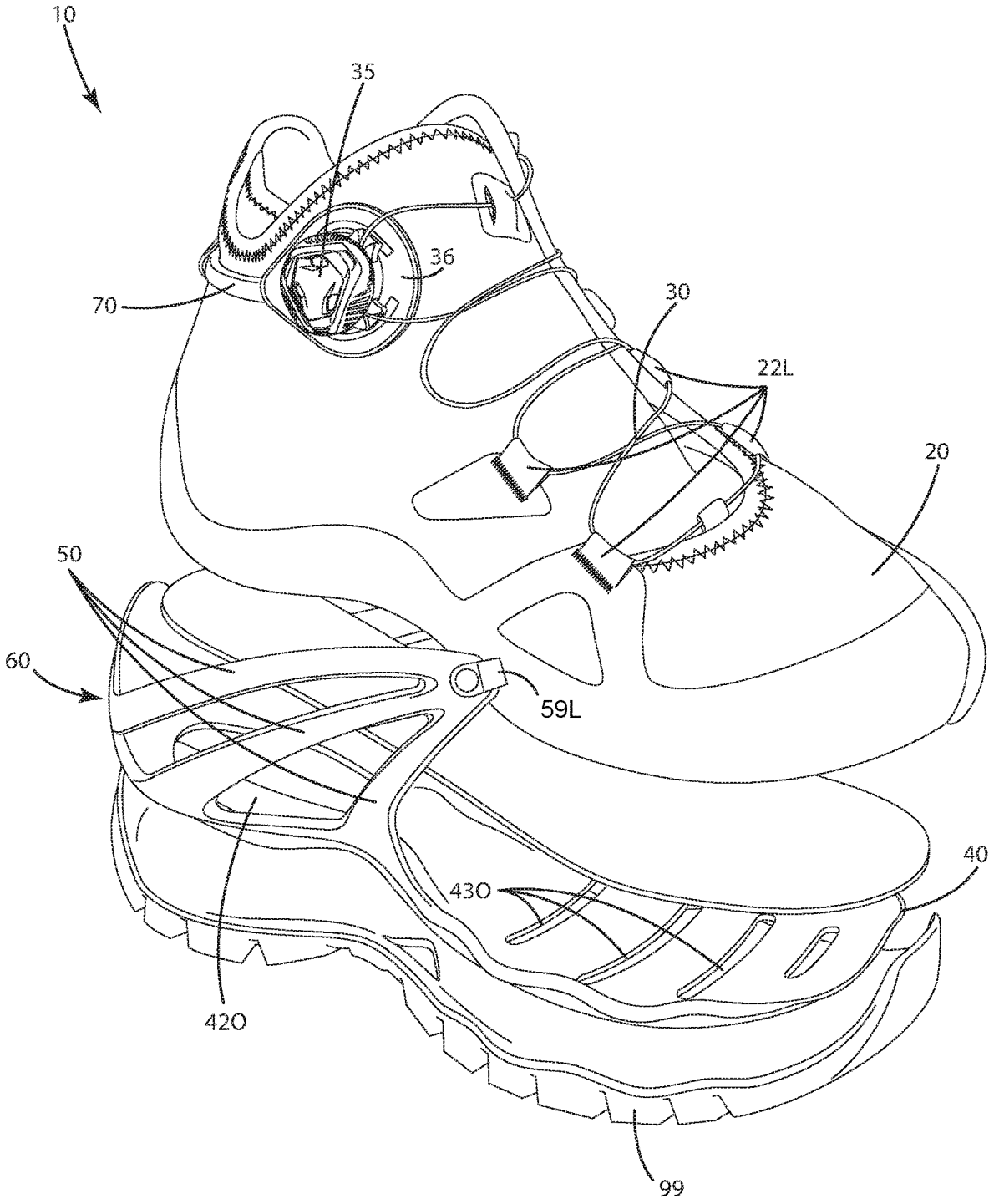
FIG. 8 is an exploded view of the footwear.

The upper 20 can be in the form of a knitted upper, constructed for example by weaving or knitting techniques, such as circular knitting, flat knitting, Jacquard knitting or other types of knitting. Alternatively, the upper 20 can be manufactured from leather, canvas, nylon, non-woven fabric, plastic sheets or other suitable materials, and may include a liner (not shown) or other accessories. As illustrated in FIGS. 1 and 6, the upper can include an ankle opening 22 and interior void 23 enclosed by the upper. The interior void 23 can extend the toe box 28 of the upper. The toe box 28 can be configured to receive the toes TS of the wearer. The toe box 28 can extend generally toward the ankle opening 22, with the instep region 29 of the upper disposed therebetween.

The instep region 29 can extend over the wearer's instep I, and optionally can include a tongue 29T. The tongue can be a fold-over tongue which is joined with a lateral quarter 29L of the upper 20 and extends across the instep region 29. The tongue 29T can be connected from the toe box 28 all the way to the ankle opening 22 on the lateral side L of the footwear to the lateral quarter 29L. The tongue can extend across the longitudinal axis to generally cover the instep I of the wearer's foot. The toe box also can extend up to a perimeter or boundary 29P of the instep region 29 that can extend from adjacent the toe box 28 and along the medial quarter 29M to the ankle opening 22. The tongue 29T can extend to this perimeter 29P and can be disposed under a portion of the medial quarter 29M to close off the instep region 29 with the tongue 29T. With this fold-over tongue, the instep I of the user's foot can be covered. Optionally, the fold-over tongue can include the opposing edge 29E. The opposing edge 29E can be disposed above or below the perimeter 29P disposed on the medial quarter 29M. Optionally, although not shown, the fold-over tongue 29T can be replaced with a conventional tongue that extends upward from the toe box 28 or vamp of the upper, with gaps on either side separating the tongue from the lateral quarter 29L and the medial quarter 29M.

The upper can include a lower portion having a peripheral allowance 24. This peripheral allowance 24 can be bent inward, extending toward the center of the footwear 10, generally toward a longitudinal axis LA of the footwear from both the lateral and medial sides L and M of the footwear. These peripheral allowances optionally cannot extend all the way to the longitudinal axis LA.

The peripheral allowance 24 can include an interior surface 241 and exterior surface 24E. The exterior surface can be glued, cemented, adhered, stitched or otherwise fastened to the interior surface 64 of the support plate 40 and generally to the frame 60. This interior surface 64 of the support plate can extend inwardly from a lateral side L of the footwear to the medial side M, crossing the longitudinal axis LA in doing so. The interior surface of the support plate 40 can extend across the width W of the support plate or footwear. The interior surface of the support plate can extend along the entire length EL of the footwear 10. Optionally, the support plate 40 can extend continuously from the lateral side L to the medial side M, across the width W and along the length EL of the footwear. In some cases an optional hole 420 can be disposed in the heel region 19 of the footwear. The hole 420 can extend through the support plate in some cases. Other holes 430 (FIG. 8) optionally can be disposed in other regions of the plate, such as the forefoot. By extending continuously across a dimension, for example, continuously across the width or continuously along the length the plate optionally can extend a majority of the width or a majority of the length, respectively. For example, there might be a hole 430 disposed in the forefoot region 17 extending through the support plate 40. The support plate then extends 51% or more of the width W in that region, such that the support plate 40 is considered to extend continuously across the width W. It will also be noted that the support plate can extend upwardly along a lower portion 24 of the upper on the lateral L and/or medial M sides of the upper 20. The support plate or portions of it, such as the rims 47, can be exposed and visible along those regions 24 of the upper 20. Optionally, the support plate rim 47 can be disposed above an uppermost portion 90U of the outsole 99. The rim 47 of the support plate can be visible between the upper and the uppermost portion 90U of the outsole as shown in FIG. 6. In some applications, the support plate 40 can be of a contrasting color relative to the upper and/or the outsole to draw out its location and inclusion in the footwear 10.

As mentioned above, the peripheral allowances 24 shown in FIG. 6, may not extend all the way to the longitudinal axis LA from the opposing lateral L and medial M sides. A gap 24G therefore can be disposed therebetween. This gap 24G can be filled by a portion of an insole 70I which can be disposed in the interior 23 of the footwear. The insole can be of a cushion material such as an EVA foam. This insole can rest on and can be in contact the interior surfaces 231 of the upper 20. The insole 70I can include a lower surface 70L that rests immediately adjacent and optionally is cemented or otherwise fastened to the interior surfaces 231 of the upper, and in particular regions 241 of the peripheral allowances 24. In some cases, the insole can include a projection or pod 70P that projects in the gap 24G and can be disposed in the heel region. Of course, the lower surface 70L of the insole 70I can include other projections to fit into other regions or gaps, depending on the application.

Figure 9:
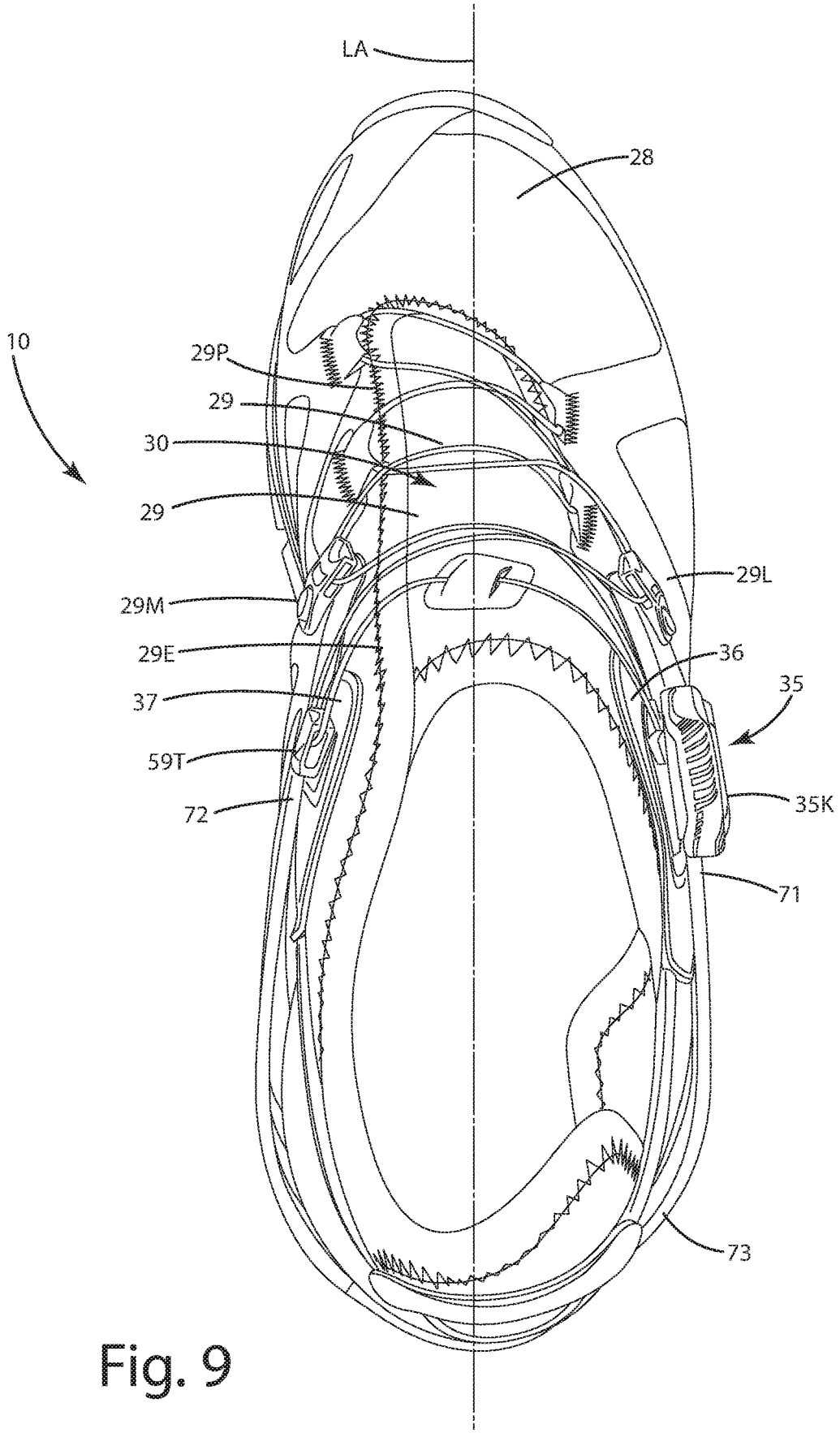
FIG. 9 is a top view of the footwear illustrating operation of the constrictor strap.
Figure 10:
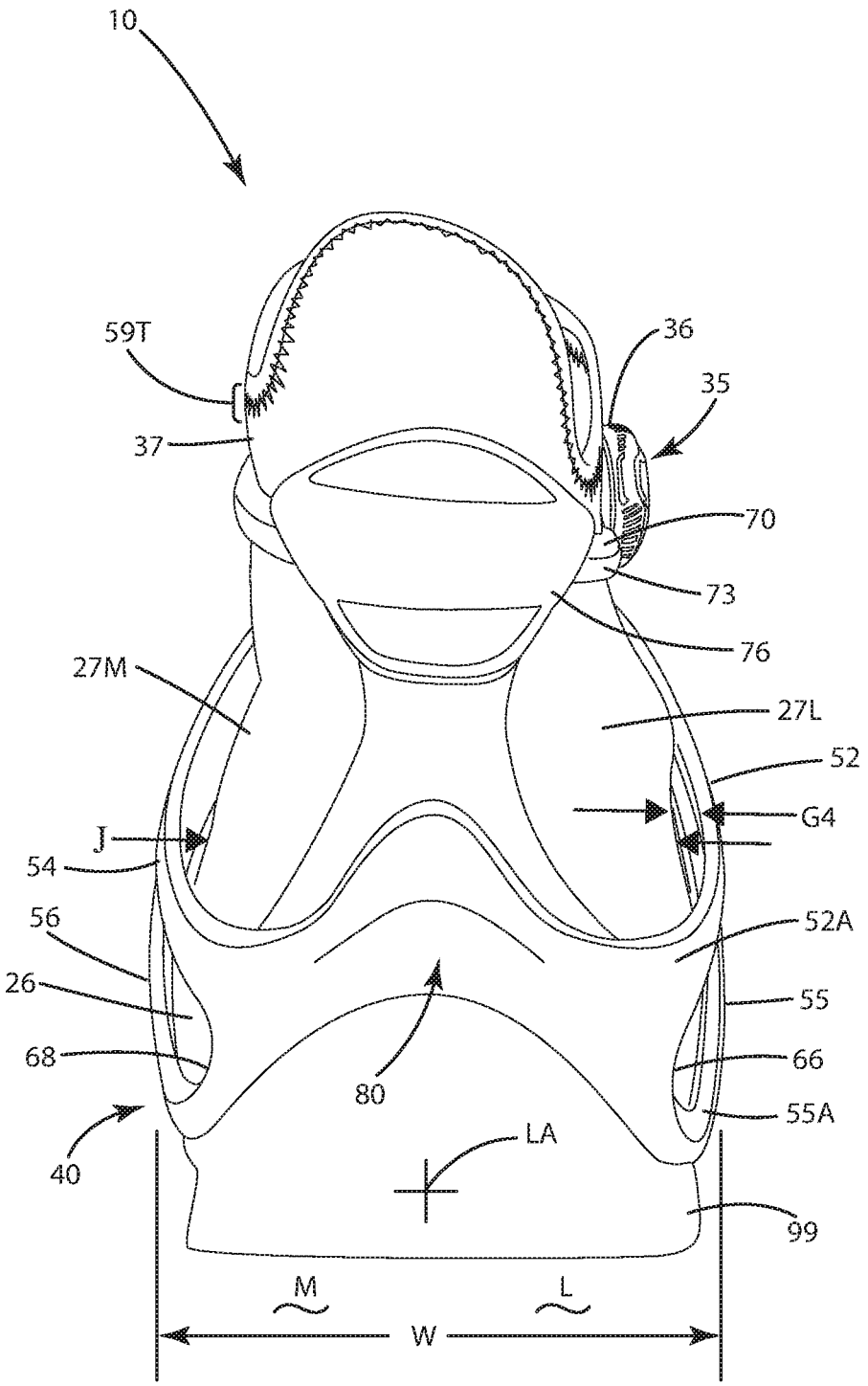
FIG. 10 is a rear view of the footwear.

As shown in FIGS. 1, 6, 9 and 10, the upper also can include a lateral exterior surface 27L and a medial exterior surface 27M. These lateral and medial exterior surfaces can be disposed on the respective lateral and medial sides of the footwear and can extend along the entire length EL of the footwear, optionally separated from one another by the longitudinal axis. As shown in FIG. 10, these lateral and medial exterior surfaces can extend from the instep downward and/or rearward, for example, in the arch 18 and heel region 19 of the footwear. These lateral and medial exterior surfaces also can extend upward toward the lacing system 30 and can include portions of the tongue 29T in the instep region 29 of the upper. The upper 20 also can include a heel portion 26 configured to extend around a rear part of the calcaneus bone of the wearer. The heel portion 26 can extend from the lateral exterior surface 27L to the medial exterior surface 27M of the upper 20.

Figure 2:
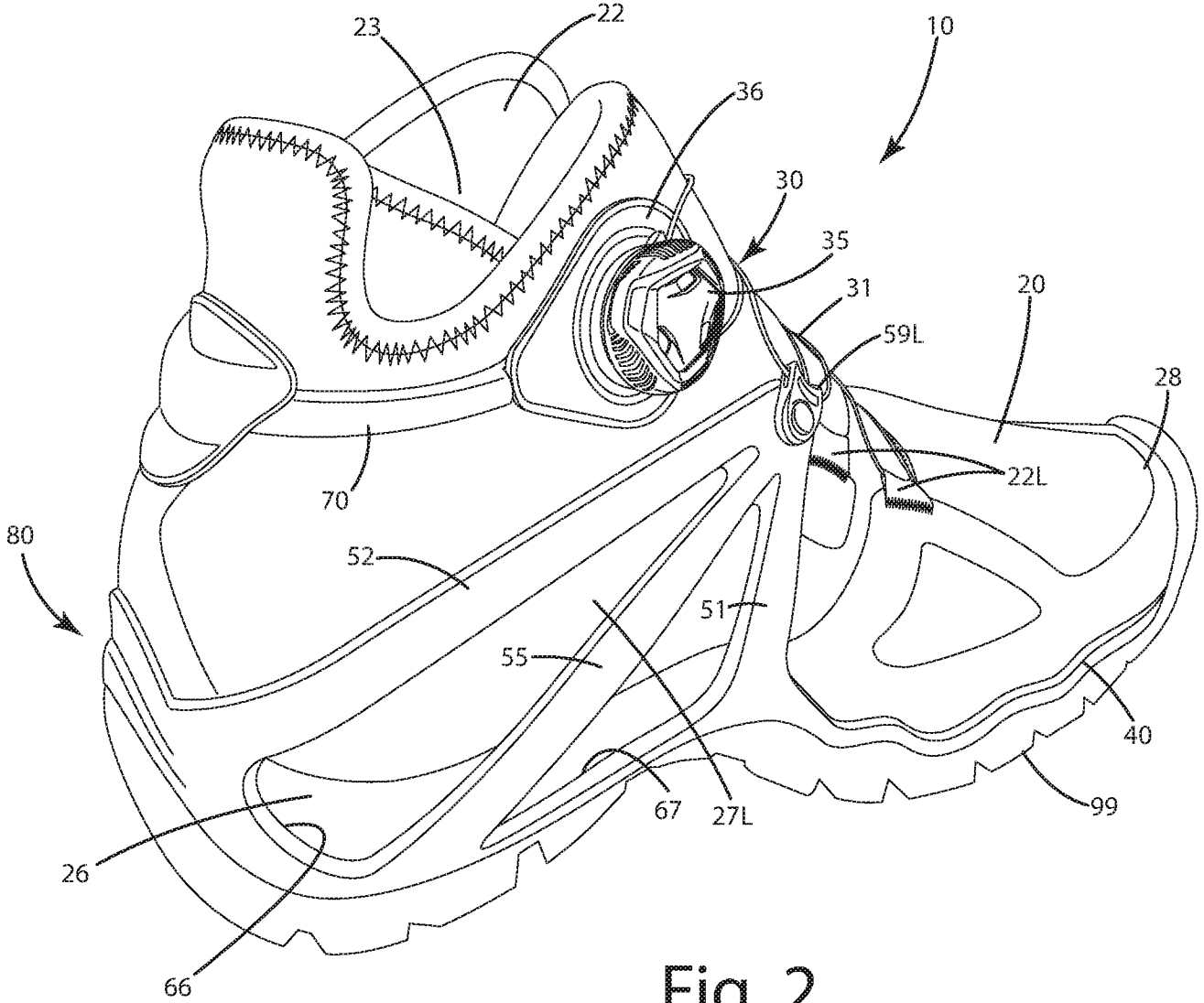
FIG. 2 is a rear perspective view thereof illustrating a constrictor strap associated with the lacing system.
Figure 4:
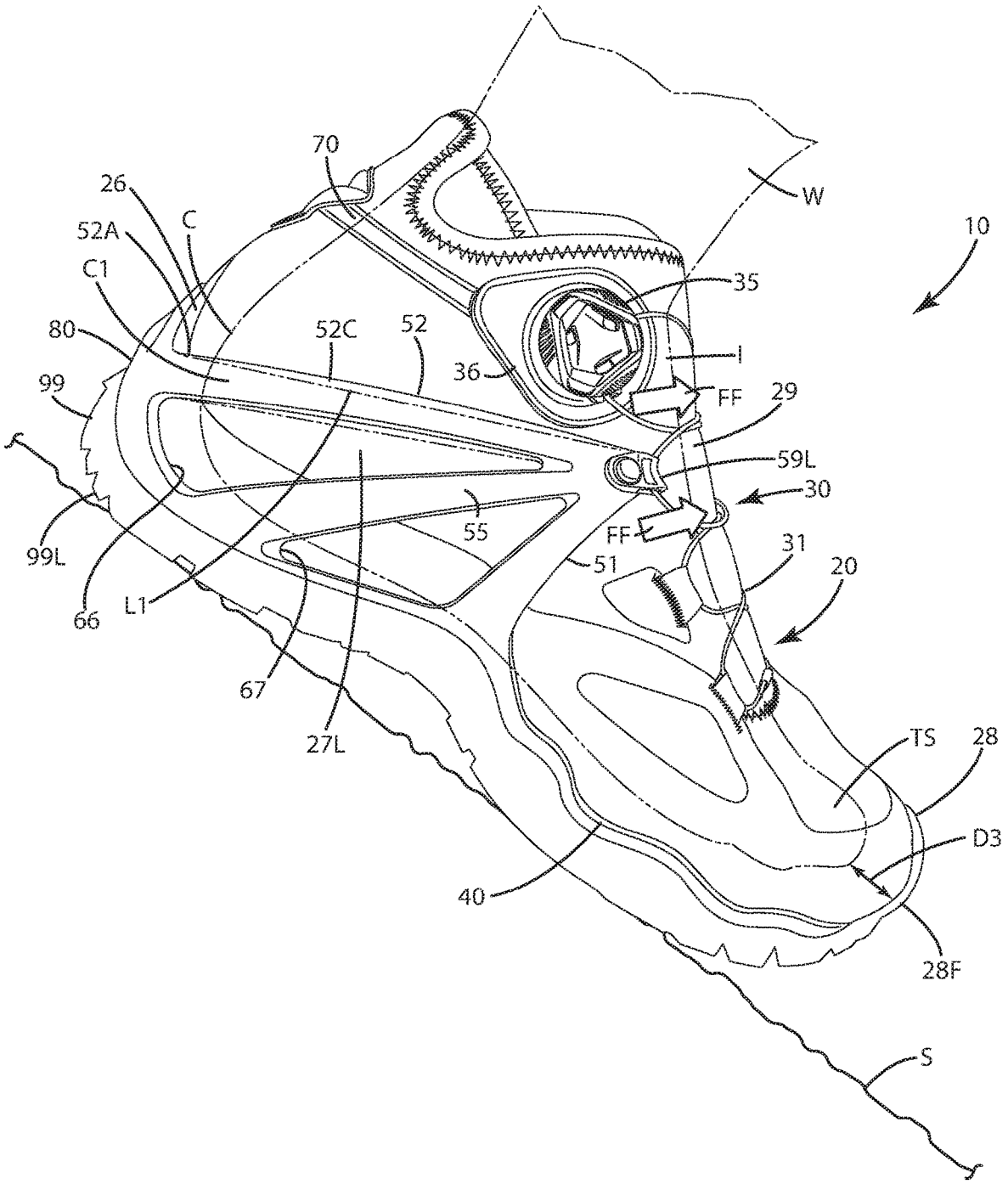
FIG. 4 is a lateral side view of the footwear being worn by a user traversing down a slope.

As noted above, the instep region 29 can include the lacing system 30. As illustrated in FIGS. 1, 2 and 4, the lacing system 30 can include lacelets 22L that are joined directly with the upper, for example, the lateral quarter 29L and adjacent the perimeter 29P of the medial quarter 29M closer to the toe box. The lacing system also can include a secondary lacelets 59L that are attached directly to the support members 50 of the holding cage and/or frame as described below. These secondary lacelets 59L are not directly attached to the exterior surfaces 27L, 27M of the upper. The lacing system 30 can include a tertiary lacelet 59T that can be disposed optionally on the medial exterior surface 27M of the upper. This tertiary lacelet 59T can be joined with a second base 37 that is itself secured to the medial exterior surface 27M of the upper, optionally adjacent the ankle opening 22. This tertiary lacelet 59T and the second base 37, as well as the tensioning member 35 described below can be disposed at a common level LI relative to the upper and the support plate or the outsole.

Although shown as closed loop lacelets, the lacelets described herein can be in the form of tubes, or c-channels that are formed on portions of the upper or components of the upper. Some other suitable lace guides for use herein can include those disclosed in U.S. Pat. Nos. 6,202,953 and 7,591,050 to Hammerslag, both of which are incorporated in their entirety herein.

The lacing system 30 can further include a lace 31 that extends through the system of lacelets as described above. This lace 31 can be continuous and optionally can be in the form of a strand, a cable, a solid core wire, a solid core polymer, a multi-filament layer or polymer, which can be braided, woven, twisted or otherwise configured, a strap, a cord, a filament and combinations of any of the foregoing. This lace can have an indefinite length and can be combined with others laces or strands. Some laces can include wire and/or a synthetic material such as nylon, rayon, polyester and/or a polyacrylic compound.

As shown in FIGS. 1, 9 and 10, the lace 31 can be disposed over the instep region 29 of the upper 20 generally over the tongue 29T and can extend to and fro between the medial quarter 29M and the lateral quarter 29L upward toward the ankle opening 22. The lace can crisscross back and forth between the lateral side and medial side of the footwear and can be wound or otherwise interfaced with the lacelets in a variety of different configurations to provide a desired movement or spatial orientation of the upper to enclose and envelop a wearer's foot disposed in the foot void 23.

The lace 31 as shown is joined with a tensioning member 35. This tensioning member 35 can be joined with a first base 36 that is itself directly joined with the upper. The first base can be fastened, stitch or otherwise secured optionally to the lateral exterior surface 27L of the upper. The base can be generally stationary, fixed and/or immovable relative to that lateral exterior surface 27L. Of course, the tensioning member 35 can be joined with other portions of the upper in different locations depending on the application. The tensioning member can be offset to the lateral side L of the longitudinal axis LA, disposed near the ankle opening 22. Optionally, the tensioning member 35 and/or base 36 can overlap a portion of the tongue 29T and can be disposed in the instep region 29 of the upper. With the tensioning member 35 disposed on the lateral side L of the footwear 10 generally is out of the way when a user walks. Thus, the tensioning member from a left footwear does not engage or rub against a right footwear or otherwise cause a tripping issue when so located.

The tensioning member 35 can be selectively adjustable so that it can either extend and/or retract the lace 31 of the lacing system 30 of which it is a part. The action can in turn draw the lateral 29L and medial 29M quarters closer to one another generally and the lace 31 can tighten relative to the lacelets, thereby taking the instep 29 downward to snugly and securely engage the instep I of the wearer's foot, locking it in place as described below. As illustrated, the tensioning member 35 can be any reel-type tensioner that spools the lace 31 on or off an internal or external spool or reel during retraction and extension of the lace, respectively, relative to the tensioning member 35. One suitable construction for the tensioning member is disclosed in U.S. Pat. No. 6,202,953 to Hammerslag, which is hereby incorporated by reference in its entirety.

The tensioning member 35 can be in the form of a rotatable and/or ratcheting reel. Tensioning member 35 can include an external knob or control 35K. The control 35K can be manually grasped by a user W and rotated to extend or retract the lace 31. The tensioning member 35 can be constructed to include a clutch and/or a stop mechanism, which can generally limit the tightening of the lace relative to the upper. This can prevent the lace and upper from becoming excessively or unintentionally overtightened. Where the tensioning member 35 is a reel-type tensioner, an optional clutch can engage when a wearer excessively rotates the control. The clutch can ensure that the knob 35K no longer rotates an internal spool. This can ensure the amount of lace that is let out or taken in from the tensioning member 35 remains the same until adjusted again.

As shown in FIGS. 1, 3, 6, 9 and 10, the lacing system 30, and a particularly tensioning member 35, can be joined with a constrictor strap 70. The constrictor strap can include a first end 71, a second distal end 72 and a central part 73 therebetween. The first end 71 can be joined with or otherwise secured to the first base 36. Again, the base 36 can be fixed and stationary relative to the upper. The second end 72 can be joined with second base 37 and/or the tertiary lacelet 59T. The central part 73 can wrap rearward around an ankle portion of the footwear and is configured to wrap around the ankle A of the wearer W from the lateral side L to the medial side M generally from the first base to the second base.

The central part 73 of the constrictor strap 70 can be constructed so that it is free-floating relative to a portion of the exterior surface. For example, the central part 73 can extend from the first end 71 of the second end 72, but between those ends, the central part 73 can be free-floating relative to the lateral exterior surface 27L and the medial exterior surface 27M, as well as all exterior surfaces of the upper between the strap ends. This is illustrated in FIG. 6. There, the constrictor strap 70, for example, the central part 73 is spaced from the exterior surfaces 27M and 27L by respective gap G2. This gap can optionally 0 mm; further optionally 0.01 mm to 1 mm; yet further optionally 0.1 mm to 2 mm; and yet further optionally 1 mm to 5 mm depending on the application and the state of the constrictor strap. The constrictor strap can be retained by a retainer 76 around the rear portion of the heel. This retainer 76 can be in the form of a piece of material or plate that is sewn or fastened over a portion of the constrictor strap 70, for example, the central part 73. The retainer can be free in the region over the constrictor strap 70 so the constrictor strap can move between the retainer and the exterior surface of the upper, generally sliding or moving over that exterior surface of the upper.

In operation, the constrictor strap 70 can function with the lacing system 30. When the tensioning member 35 is rotated, for example, when the control knob 35K is rotated, this can retract the lace 31 into the tensioning member 35. This in turn causes the lace 31 to become shorter overall. This brings the lacelets on one side of the upper toward the lacelets on the other side of the upper, and, as described below, the support members on one side of the upper generally forward toward the lacing system and instep region. This also pulls the lacing system 30 down toward the instep region 29 and thus toward the instep I of a wearer W. Due to the attachment of the lace to the tertiary lace 59T and the tensioning member 35, and those elements attachment to the first base and the second base, the constrictor strap 70 also is pulled forward toward the instep region 29 and generally toward the instep I of the wearer. As a result, the gap G2 between the central part of the constrictor strap is reduced and decreases, optionally until the interior surface of the constrictor strap engages the exterior surface of the upper. This can continue depending on the amount of tightening of the lace via the tensioning element. In some cases, the tensioning element 35 can be tightened such that the constrictor strap is pulled tightly around the ankle opening 22 toward the ankle A of the wearer W until the ankle is locked in the footwear.

As the lacing system is tightened, the central part 73 of the constrictor strap 70 can slide or move relative to the exterior surface of the upper that lays under the constrictor strap. The first and second ends of the constrictor strap can remain stationary relative to the first and second bases. The constrictor strap also can move inward in direction D as shown in FIG. 6, toward the exterior surface of the upper, generally closing and/or reducing the size of the gap G2. The lacelets can move inward and/or toward the longitudinal axis LE, and generally toward the instep region 29 or one another depending on how tight the lace 31 is drawn. Thus, the tensioning member 35 tightens the lace 31 over the instep I of the wearer, but also can simultaneously tension the constrictor strap 70 to lock that strap and the upper around the ankle A of the wearer W. This provides substantial entrapment of the wearer's foot within the footwear 10. In this manner, the wearer again can simultaneously perform two tasks with the tensioning element 35, that is, the wearer can draw the lacelets on the lateral and medial sides of the footwear toward one another, and also draw the constrictor strap tight around the ankle of the wearer, all with a single adjustment. As described below, this adjustment of the tensioning element also can cause the lacing system to interact with the holding cage to provide other functions.

Figure 5:
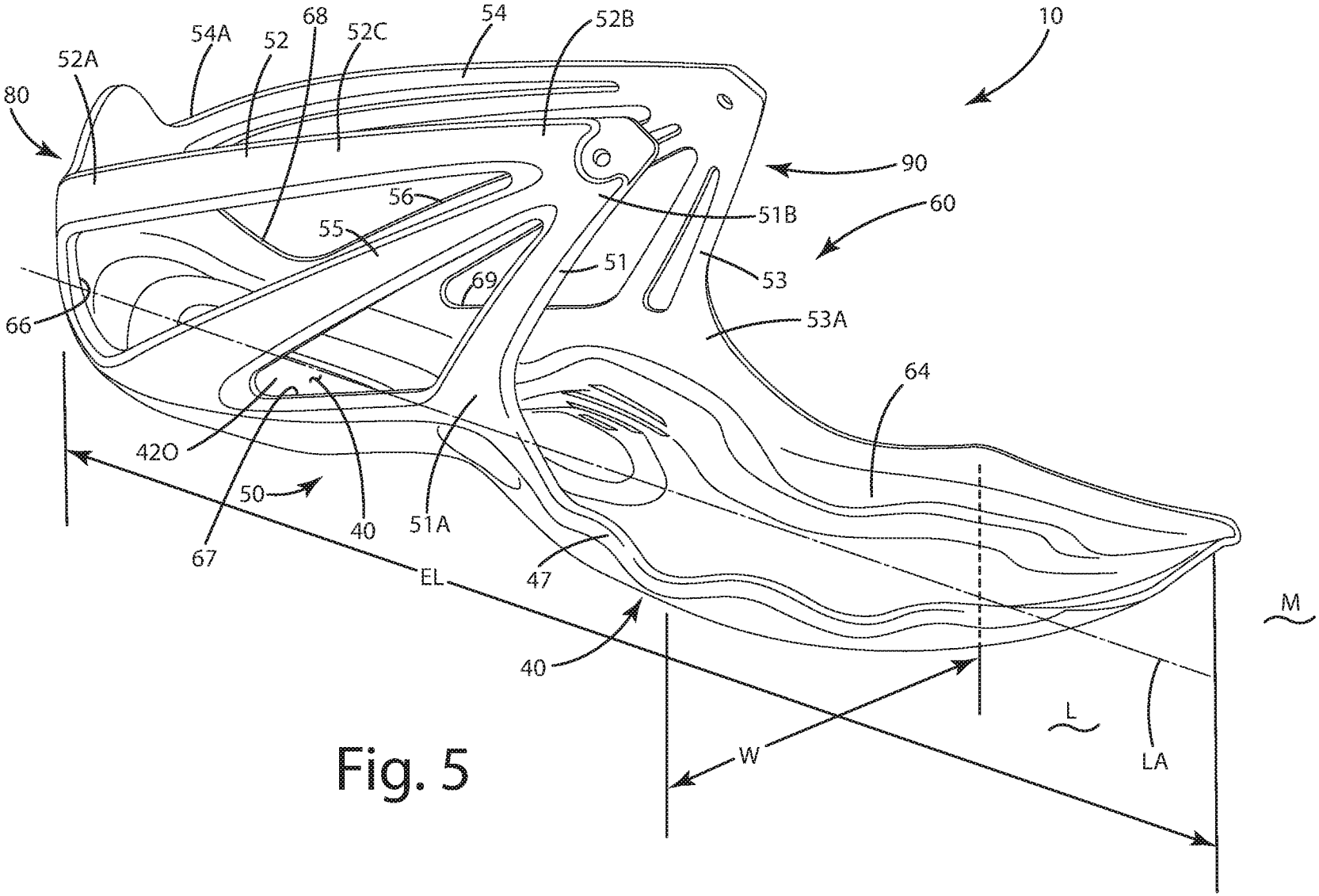
FIG. 5 is a perspective view of the holding cage separated from the footwear.

With reference to FIGS. 1, 3, 5, 6 and 10, the holding cage or frame 60 will be described in more detail. As shown in FIG. 5, the holding cage or frame 60 can include and can be integrally joined with the support plate 40. To form an integral single piece cage unit. The holding cage 60 can include the support members 50 disposed on the lateral and medial sides of the footwear. Most of the focus here will be describing the support members on the lateral side L, and it will be appreciated that the support members on the medial side M can be very similar if not identical. The holding cage 60 can include a first support member 51 extending upward from the support plate at a first location FL as shown in FIG. 3. This location can be forward of the calcaneus bone C of a wearer when the wearer's foot is in the footwear. The first support member can be free-floating relative to or disposed over the lateral exterior surface 27L. Indeed, there can be a gap disposed between the interior surface of the first support member and the exterior surface 27L. This gap optionally can be the same or similar as mentioned above in connection with the gap G2 between the constrictor strap in the exterior surfaces of the upper. The first support member 51 can extend up, toward the instep region 29 and toward the lacing system 30. The first support member 51 can include a first end 51A and a second end 51B. The first end can be generally joined to and integral with the support plate 40. The second end 51B can be disposed upward, near the secondary lacelet 59L, and as mentioned below, can be joined with the ends of other support members.

The holding cage 60 can include a second support member 52 that is disposed rearward of the first support member 51. The second support member 52 can extend upward from the support plate 40 from a second location RL that is to the rear of the calcaneus bone C of the wearer W. This second support member 52 can include a first end 52A. The first end 52A can be joined with and/or otherwise form a portion of a cradle 80 of the holding cage. The second end 52B can terminate rearward of the calcaneus bone C of the wearer. Optionally, the ends 52A and 54A of the second 52 and fourth members 54 can be disposed above the ends 51A and 53A of the first 51 and third 53 members. The second support member 52 can extend forward toward the lacing system 30, the instep region 29 and the first support member 51. In particular, the second support member 52 can extend so that the second end 52B is joined within or adjacent the second end 51B of the first support member. These ends can further be joined with the lacing system 30 and/or the secondary lacelet 59L, which in turn is joined with the lace 31 of the lacing system 30. Optionally, when the lacing system 30 is tightened by adjusting the tensioning member 35, the drawing of the lace 31 through the respective eyelets in turn pulls on the secondary lacelets 59L and the respective support members 50 on opposite sides of the holding cage. Thus, the tension in the lacing system is transmitted to all the support members.

The second support member 52 can be free-floating relative to or disposed over the lateral exterior surface. There can be a gap between the interior surface of the second member and the exterior surface, as mentioned above in connection with the constrictor strap. For example, with reference to FIG. 6, the second support member 52 can include a second central support portion 52C having a second interior surface disposed adjacent the lateral exterior surface 27L, but optionally separated therefrom via a gap G4. Again, this gap G4 can be similar in dimension to the constrictor strap gap G2 mentioned above.

The holding cage also can include a fifth support member 55 extending upward from the support plate at a fixed location AL between the first location and the second location. The fixed location AL be located adjacent (lateral of and below) the calcaneus bone C of the wearer W. This fifth support member 55 can be disposed between the first support member 51 and the second support member 52 on the lateral side L. There can be openings, holes, or apertures disposed between the first support member, second support member and fifth support member such that the exterior surface 27L is exposed between and through those openings. The fifth support member 55 can extend from a first end 55A to a second end 55B. The second end 55B can be joined integrally with and formed with the second ends 51B and 52B of the other support members. The first end 55A can extend upward from the support plate and can be integrally formed with the support plate. In some cases, this fifth support member 55 can be eliminated. In other cases, it can be integrally formed with and combined with the second support member 52 to form a very wide second support member.

As shown in FIGS. 2-5 and 10, the holding cage 60 can comprise openings, holes, or apertures disposed between the support members 51-56 such that the exterior surface of the upper 20 is exposed between and through those apertures. The holding cage 60 can have a first aperture 66 disposed between the first and second support members 51, 52 and a second aperture 68 disposed between the third and fourth support members 53, 54. As best seen in FIG. 10, the first aperture 66 can extend toward and into the heel region 19 and wraps partially around the heel portion 26 of the upper 20, such that the lateral exterior surface 27L and the heel portion 26 of the upper 20 is exposed through the first aperture 66. The first aperture 66 can extend into a rearmost portion of the heel region 19, and wraps around a rearward portion of the upper heel portion 26. The first aperture 66 can extend downward to the support plate 40, exposing the lateral exterior surface near the support plate as well, and can terminate at an edge of the support plate 40. The second aperture 68 can extend toward and into the heel region 19 and wraps partially around the heel portion 26 of the upper 20, such that the medial exterior surface 27M and the heel portion 26 of the upper 20 is exposed through the second aperture 68. The second aperture 68 can extend into a rearmost portion of the heel region 19, and wraps around a rearward portion of the upper heel portion 26. The second aperture 68 can extend downward to the support plate 40, exposing the medial exterior surface near the support plate as well, and can terminate at an edge of the support plate 40. Referring to FIG. 4, the first aperture 66 can extend between the second and fifth support members 52, 55. The holding cage 60 can have a third aperture 67 disposed forwardly of the first aperture 66 and extending between the first and fifth support members 51, 55, such that the lateral exterior surface 27L of the upper 20 is exposed through the third aperture 67. Referring to FIG. 3, the second aperture 68 can extend between the fourth and sixth support members 54, 56. The holding cage 60 can have a fourth aperture 69 disposed forwardly of the second aperture 68 and extending between the third and sixth support members 53, 56, such that the medial exterior surface 27M of the upper 20 is exposed through the fourth aperture 69.

Each of the first 51, second 52, and fifth 55 support members can be constructed from the material from which the overall frame 60 is constructed. This material can be an elastomer, plastic, thermoplastic, rubber, composite, leather or other materials depending on the application. Generally, a rigid yet somewhat flexible material can be suitable for use with the support members. Optionally, the frame, support members and holding cage as shown can take on a variety of different aesthetic configurations and designs, regardless of whether these features are functional or not.

As mentioned above, the second support member 52 can include a second central support portion 52C. The second central support portion 52C can be operable in a relaxed mode and a tensioned mode, as depicted in FIG. 4. There, a user can be traversing a downhill slope S, with the footwear 10 generally pointed downhill. In this case, the outsole 99 of the footwear, located below the holding cage or frame 60, engages the surface of the slope S. The outsole 99 includes a plurality of lugs 99L. The support plate 40, is located above that outsole 99. The support members 51, 52 and 55, and the corresponding support members 53, 54 and 56 on the opposite side of the footwear can be coupled with the lacing system 30. The optional constrictor strap 70 can prevent the wearer's foot, in particular wearer's toes TS, from substantially reducing the distance D3 between the wearer's toes TS and the forward portion 28F of the toe box 28 to prevent the toes from being compressed under force.

As depicted in FIG. 4, when the wearer traverses down such a slope S, the wearer's instep I presents a forward force F on the instep region 29 of the upper 20. This translates through the lace 31. Due to the lace 31 being attached to the support members 51-56, the support members are put under additional tension, because they are pulled forwardly toward the instep region, that is, they form as a result of this tension, the support members can change in shape and spatial orientation. For example, the second support member 52, in particular, the second central support portion is initially shown in its relaxed mode, before any force FF is placed on the instep region 29, and in which the second central support portion includes a slight curve C1. Due to the forward forces FF exerted on the footwear 10, as the wearer's weight is exerted through the footwear to the slope, the support members can translate to a tensioned mode.

In particular, when the holding cage is in an unloaded state via the wearer traversing a level surface, different from the slope S, the slight curve C1 is evident and visible in the second support member 52. However, the second support member is also operable in the tensioned mode. In this tensioned mode, the second central support portion 52C straightens to achieve the linear shape L1 when the holding cage is in a loaded state via the wearer traversing down the slope S. As a result, the curve C1 in the support member 52 becomes less curved or more linear to achieve a more straight or linear shape L1 when the user traverses down the slope S. The forward force F1 pushes against the lacing system 30 which in turn pulls the support members 52 under force to produce a tension in those members. Because the first end 52A of the support member 52 joined with a cradle 80 that encloses at least a portion of the calcaneus bone C of the wearer's foot, the support member 52 absorbs this force under tension. Because the cradle is locked against the calcaneus bone C, the member 52 can stretch and somewhat reorient itself relative to the exterior surface of the upper. The other support members 51 and 55, as well as the support members 53, 54 and 56 on the medial side M of the footwear can likewise straighten from a slightly curved configuration to a less curved or linear configuration. In some cases, however, the forwardmost support members, for example 51 and 53, do not bend or straighten as much is the second 52 and fourth 54 members because the members 51 and 53 do not store or undergo as much tension as the second 52 or fourth 54 support members.

Put another way, as shown in FIG. 4, when a user W traverses a downhill slope S and otherwise puts forward force FF on the instep region 29, this force translates to the lacing system 30. That force FF is transmitted as a tension through one or more of the first 51, second 52, and fifth 55 support members of the lateral side L, as well as the third 53, fourth 54, and sixth 56 support members on the medial side M of the footwear. In this manner, a tension created by the forward force against the lacing system is transmitted to the secondary lacelets 59L. Which translates as tension to the first support member, second support member, third support member, fourth support member, fifth support member and sixth support member. Optionally, the second support member 52 and fourth support member 54 can be configured to absorb and handle much of the forward force FF that is transmitted to the holding cage from the lacing system 30 so that the foot does not slide forward over the support plate 40. For example, with reference to FIG. 4, when the forward force FF of the wearer's instep I was placed against the instep region 29 and ultimately the lacing system 30 of the footwear, the holding cage 60 attains a loaded state. In this loaded state, that forward force FF is distributed more to the second support member and the fourth support member. As an example, comparing the force distributed to the first support member 51 compared to the second support member 52, where the tension is measured in pounds force, the tension in the second support member relative to the tension in pounds force in the first support member can be in a ratio that is greater than 1:1. The tension in pounds force in the second support member relative to the tension in pounds force in the first support member can be in a ratio of optionally at least 1.25:1; further optionally at least 1.5:1; further optionally at least 2:1; further optionally at least 2.5:1; yet further optionally three: at least 3:1; and yet further optionally between 1.5:1 and 20:1 depending on the application, the slope, the weight of the wearer and the general configuration of the support members.

With reference to FIGS. 4 and 5, the support members interaction with one another will be further described. In particular, the second 52 and fourth 54 support members can cooperatively form a cradle 80 that extends around and rearward of the calcaneus bone C of the wearer W. The cradle second and fourth members also are joined with the lacing system 30 as described above such that when the holding cage is in a loaded state, the lacing system 30 translates the forward force FF of the wearer's instep I against the lacing system 30 through the second and fourth support members, such that the cradle 80 is pulled toward the calcaneus bone with a lacing system, so as to impair the foot from sliding forward over the support plate 40. This in turn can keep the toes TT preselected distance D3 from the forwardmost portion 28F of the toe box 28. As mentioned above, this can prevent the toes from being compressed in the toe box and slamming against the forward portion of the toe box, causing discomfort to the wearer. The cradle can extend upward from the support plate 40 and can form a portion of the support plate. The support plate, extending upward to the cradle 80 can be of a generally concave configuration, well suited to receive a heel of the wearer. This portion of the support plate can extend around the rounded and bulbous rear of the wearer's foot corresponding to the calcaneus bone C.

Optionally, when traversing downward on the slope, the support members also can decrease in distance from the exterior surfaces of the upper over which they lay. For example, as shown in FIG. 10, the gap G4 can be substantially reduced to zero when traversing down the slope. This is due to the support members becoming more taut and being pulled inward in direction J toward the exterior surfaces of the upper.

Further optionally, the fifth 55 and sixth 56 support members on opposite sides of the longitudinal axis LA also can form a portion of the cradle 80. In other cases, the cradle 80 can be formed by the second and fourth members being joined with another plate or piece of material that extends around the rear portion of the calcaneus bone rearward of the calcaneus bone.

In operation, the lacing system 30 and the support members 50 can function to lock the wearer's foot in place by engaging the calcaneus bone C and instep I of the wearer. In particular, when the tensioning member 35 is tightened by rotating the dial or control 35K, the lace 31 is retracted toward the member 35. This causes the lace to tighten, thereby pulling the lacelets toward one another and the longitudinal axis LA. The secondary lacelets 59L are pulled under tension via the lace 31. Because they are joined with the first 51 and third 53 support members, this pulls the support plate 40 upward so the foot is trapped between instep region 29 and the plate 40. However, the tension also is transmitted through the second 52 and fourth 54 support members. The tension in these support members has a horizontal (forward) component as well as an upward component. Then, these members pull the cradle forward under tension to engage that cradle on the rear part of the calcaneus bone. This in turn locks the cradle 80 around the rear of the calcaneus bone C. It also further tightens so that the foot is clenched between the cradle 80 rearward of the calcaneus bone C and the lacing system 30. Where the tensioning member 35 is joined with a constrictor strap, as noted above, the constrictor strap simultaneously can be tightened to grasp the wearer's ankle A; again while the foot is clamped between the instep region and the support plate, and while the calcaneus bone is trapped in the cradle with the instep region pulled back toward the cradle via the laces being tightened.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation (s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An article of footwear comprising:

an arch region, a heel region joined with and rearward of the arch region, and a forefoot region joined with and forward of the arch region;

an upper defining a foot void configured to receive a wearer's foot, the upper including an heel portion configured to extend around a rear part of a calcaneus bone of the wearer, the upper including a lateral exterior surface and a medial exterior surface, the heel portion extending from the lateral exterior surface to the medial exterior surface, the lateral exterior surface and medial exterior surface extending upward toward a lacing region;

a lacing system disposed in the lacing region of the upper;

an outsole including a plurality of lugs;

a support plate constructed from a rigid but flexible first material, the support plated positioned in-between the outsole and the upper, the support plate extending continuously from a lateral side to a medial side of the footwear and extending from the heel region, through the arch region and into the forefoot region of the footwear; and a holding cage integrally joined with the support plate, so as to form a single piece cage unit, the holding cage constructed from the first material, the holding cage comprising:

a first support member extending upward from the support plate at a first location in the arch region of the footwear, the first location configured to be forward of the calcaneus bone of the wearer, the first support member being free floating relative to and disposed over the lateral exterior surface of the upper, the first support member extending up and to a first support member end and joined with the lacing system;

a second support member rearward of the first support member, the second support member extending upward from the support plate from a second location in the heel region of the footwear, the second location configured to be disposed to the rear of the calcaneus bone of the wearer, forward toward the first support member, the second support member including a second support member end directly joined with the first support member end and joined with the lacing system, the second support member being free floating relative to and disposed over the lateral exterior surface of the upper, the second support member having a second central support portion having a second interior surface disposed adjacent the lateral exterior surface of the upper, a third support member extending upward from the support plate at a third location in the arch region of the footwear, the third location configured to be forward of the calcaneus bone of the wearer, the third support member being free floating relative to and disposed over the medial exterior surface of the upper, the third support member extending upward to a third support member end and joined with the lacing system, and a fourth support member rearward of the third support member, the fourth support member extending upward from the support plate from a fourth location in the heel region of the footwear, the fourth location configured to be disposed to the rear of the calcaneus bone of the wearer, forward toward the third support member, the fourth support member including a fourth support member end directly joined with the third support member end and joined with the lacing system, the fourth support member being free floating relative to and disposed over the medial exterior surface of the upper, the fourth support member having a fourth central support portion having a fourth interior surface disposed adjacent the medial exterior surface of the upper, wherein the second support member and the fourth support member cooperatively form a cradle that extends around and rearward of the heel portion, the second support member and the fourth support member extending from the heel region and into the arch region of the footwear, wherein a first aperture is disposed between the first and second support members, the first aperture extending into the heel region and wrapping at least partially around the heel portion of the upper, such that the lateral exterior surface and the heel portion of the upper is exposed through the first aperture, wherein the first aperture extends downward to the support plate and terminates directly adjacent an edge of the support plate, wherein a second aperture is disposed between the third and fourth support members, the second aperture extending into the heel region and wrapping at least partially around the heel portion of the upper, such that the medial exterior surface and the heel portion of the upper is exposed through the second aperture, wherein the second aperture extends downward to the support plate and terminates directly adjacent the edge of the support plate, wherein the second support member and the fourth support member are joined with the lacing system such that when the holding cage is in a loaded state, the lacing system is configured to translate a forward force of the wearer's instep against the lacing system through the second and fourth support members such that the cradle is pulled toward the calcaneus bone, with the lacing system, so as to impair the foot from sliding forward over the support plate.

2. The article of footwear of claim 1, wherein the second central support portion is operable in a relaxed mode in which the second central support portion includes a curve when the holding cage is in an unloaded state via the wearer traversing a level surface, wherein the second central support portion is operable in a tensioned mode in which the second central support portion curve straightens when the holding cage is in the loaded state via the wearer traversing down a sloped surface.

3. The article of footwear of claim 2, comprising: a fifth support member extending upward from the support plate at a fifth location between the first location and the second location, the fifth location configured to be located adjacent the calcaneus bone of the wearer, the fifth support member being joined with at least one of the first support member end and the second support member end so that a tension in the lacing system is transmitted to the first support member, the second support member and the fifth support member when the lacing system is tightened.

4. The article of footwear of claim 3, wherein the first support member end and the second support member end are joined with a lacelet, wherein the lacelet is joined with a lace of the lacing system.

5. The article of footwear of claim 3, wherein: the first aperture extends between the second and fifth support members, and a third aperture is disposed forwardly of the first aperture and extends between the first and fifth support members such that the lateral exterior surface of the upper is exposed through the third aperture.

6. The article of footwear of claim 1, wherein the forward force of the wearer's instep against the lacing system, when the holding cage is in the loaded state, is distributed between the first support member and the second support member such that a tension in pounds force in the second support member relative to the tension in pounds force in the first support member is in a ratio of at least 1.25:1.

7. The article of footwear of claim 6, wherein the ratio is at least 1.5:1.

8. The article of footwear of claim 7, wherein the ratio is at least 2:1.

9. The article of footwear of claim 1, comprising: a tensioner including a portion through which a lace of the lacing system extends; and a constrictor strap having a first end joined with the tensioner on the lateral exterior surface, the constrictor strap extending over the lateral exterior surface, around to the medial exterior surface, the constrictor strap being free floating relative to a portion of the lateral exterior surface and a portion of the medial exterior surface, the constrictor strap having a second end joined with a lacelet on the medial exterior surface.

10. The article of footwear of claim 9, wherein the tensioner is operable in a tightening mode in which the lace is tightened to thereby pull the holding cage against the lateral and medial exterior surfaces, wherein the tensioner in the tightening mode is configured to simultaneously tighten the constrictor strap around an ankle of the wearer.

11. The article of footwear of claim 1 comprising: a tensioner including a portion through which a lace of the lacing system extends, a constrictor strap joined with the tensioner, the constrictor strap extending over the lateral exterior surface, around to the medial exterior surface, the constrictor strap being free floating relative to a portion of the lateral exterior surface and a portion of the medial exterior surface, wherein the tensioner is operable in a tightening mode in which the lace is tightened to thereby pull the holding cage against the lateral and medial exterior surfaces, wherein the tensioner in the tightening mode is configured to simultaneously tighten the constrictor strap around an ankle of the wearer.

12. The article of footwear of claim 1, wherein at least one of the first aperture and the second aperture extends into a rearmost portion of the heel region, and wraps around a rearward portion of the upper heel portion.

* * * * *